US010971901B2

(12) United States Patent
Ban

(10) Patent No.: US 10,971,901 B2
(45) Date of Patent: Apr. 6, 2021

(54) IGNITION PLUG

(71) Applicant: NGK SPARK PLUG CO., LTD., Nagoya (JP)

(72) Inventor: Kenji Ban, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 16/911,723

(22) Filed: Jun. 25, 2020

(65) Prior Publication Data

US 2021/0013704 A1 Jan. 14, 2021

(30) Foreign Application Priority Data

Jul. 10, 2019 (JP) ..... JP2019-128096

(51) Int. Cl.
*H01T 13/34* (2006.01)
*H01T 21/02* (2006.01)

(52) U.S. Cl.
CPC ..... *H01T 13/34* (2013.01); *H01T 21/02* (2013.01)

(58) Field of Classification Search
CPC ..... H01T 13/34; H01T 21/02
See application file for complete search history.

(56) References Cited

U.S. PATENT DOCUMENTS

2017/0018909 A1* 1/2017 Fujimura ..... F02P 11/00

FOREIGN PATENT DOCUMENTS

JP H09-219273 A 8/1997

* cited by examiner

*Primary Examiner* — Donald L Raleigh
(74) *Attorney, Agent, or Firm* — Kusner & Jaffe

(57) ABSTRACT

A spark plug that improves the heat resistance performance of an ignition plug.

12 Claims, 6 Drawing Sheets

FIG. 4A

TA

| No. | Dx1 (mm) | Dn2 (mm) | Dn2/Dx1 | EVALUATION |
|---|---|---|---|---|
| A1 | 6.25 | 6.2 | 0.992 | A |
| A2 | 6.25 | 6 | 0.960 | A |
| A3 | 6.25 | 5.8 | 0.928 | A |
| A4 | 6.25 | 5.6 | 0.896 | A |
| A5 | 6.25 | 5.4 | 0.864 | B |

FIG. 4B

TB

| No. | Dm (mm) | Dx1 (mm) | dD (Dm-Dx1) (mm) | E101 (mm) | | HEAT RESISTANCE PERFORMANCE | DURABILITY |
|---|---|---|---|---|---|---|---|
| B1 | 6.55 | 6.25 | 0.3 | 1.8 | L | – | – |
| B2 | 6.5 | 6.25 | 0.25 | 1.8 | L | C | |
| B3 | 6.45 | 6.25 | 0.2 | 0.3 | (1/6)L | C | |
| B4 | 6.45 | 6.25 | 0.2 | 0.6 | (1/3)L | B | |
| B5 | 6.45 | 6.25 | 0.2 | 1.8 | L | B | |
| B6 | 6.45 | 6.25 | 0.2 | 2.7 | (3/2)L | B | X |
| B7 | 6.45 | 6.25 | 0.2 | 3.6 | 2L | B | Y |
| B8 | 6.4 | 6.25 | 0.15 | 1.8 | L | B | |
| B9 | 6.35 | 6.25 | 0.1 | 1.8 | L | A | |
| B10 | 6.3 | 6.25 | 0.05 | 0.3 | (1/6)L | C | |
| B11 | 6.3 | 6.25 | 0.05 | 0.6 | (1/3)L | A | |
| B12 | 6.3 | 6.25 | 0.05 | 1.8 | L | A | |
| B13 | 6.3 | 6.25 | 0.05 | 2.7 | (3/2)L | A | X |
| B14 | 6.3 | 6.25 | 0.05 | 3.6 | 2L | A | Y |

IGNITION PLUG

FIELD OF THE INVENTION

The present specification relates to an ignition plug.

BACKGROUND OF THE INVENTION

Conventionally, an ignition plug is used to ignite fuel in an apparatus in which fuel is burned (e.g., an internal combustion engine). The ignition plug includes, for example, a tubular metallic shell, an insulator having a through hole and fixed on the inner-circumference side of the metallic shell, and a center electrode inserted at least partially into a forward-end side portion of the through hole of the insulator, as disclosed in Japanese Patent Application Laid-Open (kokai) No. H09-219273.

In recent years, in order to improve the efficiency of an internal combustion engine, combustion temperature tends to increase. Because of contact with combustion gas, a forward-end side portion of the insulator is apt to increase in temperature. By means of reducing the size of the forward-end side portion of the insulator, the heat resistance performance of the ignition plug can be improved. However, since the length of a path extending from the center electrode to the metallic shell along the surface of the insulator becomes short, an unintended discharge could occur along such a path. As seen from the above, it has not been easy to improve the heat resistance performance of the ignition plug.

SUMMARY OF THE INVENTION

The present specification discloses a technique for improving the heat resistance performance of the ignition plug.

The technique disclosed in the present specification can be implemented as the following application examples.

APPLICATION EXAMPLE 1

An ignition plug comprises an insulator having a through hole extending from a rear-end side toward a forward-end side along an axial line; a tubular metallic shell fixed to an outer circumference of the insulator and extending along the axial line; and a center electrode inserted at least partially into a portion of the through hole of the insulator, the portion being located on the forward-end side. The insulator has a large-diameter portion having a largest outside diameter, a forward-end-side trunk portion connected to an end of the large-diameter portion on the forward-end side and smaller in outside diameter than the large-diameter portion, and an outer step portion connected to an end of the forward-end-side trunk portion on the forward-end side and reducing in outside diameter toward the forward-end side. The forward-end-side trunk portion has an inner step portion reducing in inside diameter toward the forward-end side. The metallic shell has a support portion reducing in inside diameter toward the forward-end side and supporting directly or indirectly the outer step portion of the insulator. The center electrode has a diameter-reducing portion reducing in outside diameter toward the forward-end side and supported by the inner step portion of the insulator. The letter L represents a distance along the axial line from a boundary position, which is the position of a boundary between the forward-end-side trunk portion and the outer step portion of the insulator in a direction of the axial line, to a rear-end position of a contact region between the diameter-reducing portion of the center electrode and the inner step portion of the insulator. The difference between an inside diameter of the metallic shell and an outside diameter of the insulator is 0.2 mm or less in a first range ranging from the boundary position to a position which is located on the rear-end side of the boundary position and whose distance from the boundary position along the axial line is L/3. The difference between the inside diameter of the metallic shell and the outside diameter of the insulator is greater than 0.2 mm in a second range located on the rear-end side of a position which is located on the rear-end side of the boundary position and whose distance from the boundary position along the axial line is 3L/2, the second range being located on the forward-end side of the large-diameter portion. A relation of $0.9 \leq Dn2/Dx1 < 1$ is satisfied between a largest outside diameter Dx1 of the insulator in the first range and a smallest outside diameter Dn2 of the insulator in the second range.

According to the present configuration, since, in the first range on the rear-end side of the boundary position between the forward-end-side trunk portion and the outer step portion of the insulator, the difference between the inside diameter of the metallic shell and the outside diameter of the insulator is 0.2 mm or less, heat conduction from the insulator to the metallic shell is accelerated, and the heat resistance performance of the ignition plug can be improved. Also, since, in the second range on the rear-end side of the boundary position between the forward-end-side trunk portion and the outer step portion of the insulator, the difference between the inside diameter of the metallic shell and the outside diameter of the insulator is greater than 0.2 mm, the ignition plug can be easily manufactured. Further, since a relation of $0.9 \leq Dn2/Dx1 < 1$ is satisfied, fissuring in the insulator can be restrained.

APPLICATION EXAMPLE 2

An ignition plug comprises an insulator having a through hole extending from a rear-end side toward a forward-end side along an axial line; a tubular metallic shell fixed to an outer circumference of the insulator and extending along the axial line; and a center electrode inserted at least partially into a portion of the through hole of the insulator, the portion being located on the forward-end side. The insulator has a large-diameter portion having a largest outside diameter, a forward-end-side trunk portion connected to an end of the large-diameter portion on the forward-end side and smaller in outside diameter than the large-diameter portion, and an outer step portion connected to an end of the forward-end-side trunk portion on the forward-end side and reducing in outside diameter toward the forward-end side. The forward-end-side trunk portion has an inner step portion reducing in inside diameter toward the forward-end side. The metallic shell has a support portion reducing in inside diameter toward the forward-end side and supporting directly or indirectly the outer step portion of the insulator. The center electrode has a diameter-reducing portion reducing in outside diameter toward the forward-end side and supported by the inner step portion of the insulator. The letter L represents a distance along the axial line from a boundary position, which is the position of a boundary between the forward-end-side trunk portion and the outer step portion of the insulator in a direction of the axial line, to a rear-end position of a contact region between the diameter-reducing portion of the center electrode and the inner step portion of the insulator. The difference between an inside diameter of the metallic shell and an outside diameter of the insulator is 0.2 mm or less in a first range ranging from the boundary position to a position which is located on the rear-end side of the boundary position and whose distance from the boundary position along the axial line is L/3. The difference between the inside diameter of the metallic shell and the outside diameter of the insulator is greater than 0.2 mm in a second range located on the rear-end side of a position which is located on the rear-end side of the boundary position and whose distance from the boundary position along the axial line is 3L/2, the second range being located on the forward-end side of the large-diameter portion. A largest inside diameter of the metallic shell in the first range is smaller than a smallest inside diameter of the metallic shell in the second range.

According to the present configuration, since, in the first range on the rear-end side of the boundary position between the forward-end-side trunk portion and the outer step portion of the insulator, the difference between the inside diameter of the metallic shell and the outside diameter of the insulator is 0.2 mm or less, heat conduction from the insulator to the metallic shell is accelerated, and the heat resistance performance of the ignition plug can be improved. Also, since, in the second range on the rear-end side of the boundary position between the forward-end-side trunk portion and the outer step portion of the insulator, the difference between the inside diameter of the metallic shell and the outside diameter of the insulator is greater than 0.2 mm, the ignition plug can be easily manufactured.

APPLICATION EXAMPLE 3

An ignition plug according to application example 1 or 2 is configured as follows: in at least a portion of the first range, the difference between the inside diameter of the metallic shell and the outside diameter of the insulator is 0.1 mm or less.

According to the present configuration, since heat conduction from the insulator to the metallic shell is further accelerated, the heat resistance performance of the ignition plug can be improved.

APPLICATION EXAMPLE 4

An ignition plug according to any one of application examples 1 to 3 is configured as follows: in at least a portion of the first range, the difference between the inside diameter of the metallic shell and the outside diameter of the insulator is 0.05 mm or less.

According to the present configuration, since heat conduction from the insulator to the metallic shell is further accelerated, the heat resistance performance of the ignition plug can be improved.

APPLICATION EXAMPLE 5

An ignition plug according to any one of application examples 1 to 4 is configured as follows: the difference between the inside diameter of the metallic shell and the outside diameter of the insulator is 0.2 mm or lesson in a third range located on the rear-end side of a position which is located on the rear end side of the boundary position and whose distance from the boundary position along the axial line is L/3, the third range being located on the forward-end side of a position which is located on the rear end side of the boundary position and whose distance from the boundary position along the axial line is L.

According to the present configuration, since heat conduction from the insulator to the metallic shell is further accelerated, the heat resistance performance of the ignition plug can be improved.

APPLICATION EXAMPLE 6

An ignition plug according to any one of application examples 1 to 5 is configured as follows: over the entire first range, the difference between the inside diameter of the metallic shell and the outside diameter of the insulator is 0.1 mm or less.

According to the present configuration, since heat conduction from the insulator to the metallic shell is further accelerated, the heat resistance performance of the ignition plug can be improved.

APPLICATION EXAMPLE 7

An ignition plug according to any one of application examples 1 to 6 is configured as follows: over the entire first range, the difference between the inside diameter of the metallic shell and the outside diameter of the insulator is 0.05 mm or less.

According to the present configuration, since heat conduction from the insulator to the metallic shell is further accelerated, the heat resistance performance of the ignition plug can be improved.

The technique disclosed in the present specification can be implemented in various forms; for example, an ignition plug, an ignition apparatus using the ignition plug, an internal combustion engine having the ignition plug, and an internal combustion engine carrying the ignition apparatus using the ignition plug.

BRIEF DESCRIPTION OF THE DRAWINGS

FIGS. 4A and 4B are a first table TA and a second table TB each showing the correspondence of structural parameters to test results with respect to ignition plug samples.

DETAILED DESCRIPTION OF THE INVENTION

A. First Embodiment

Figure 1:
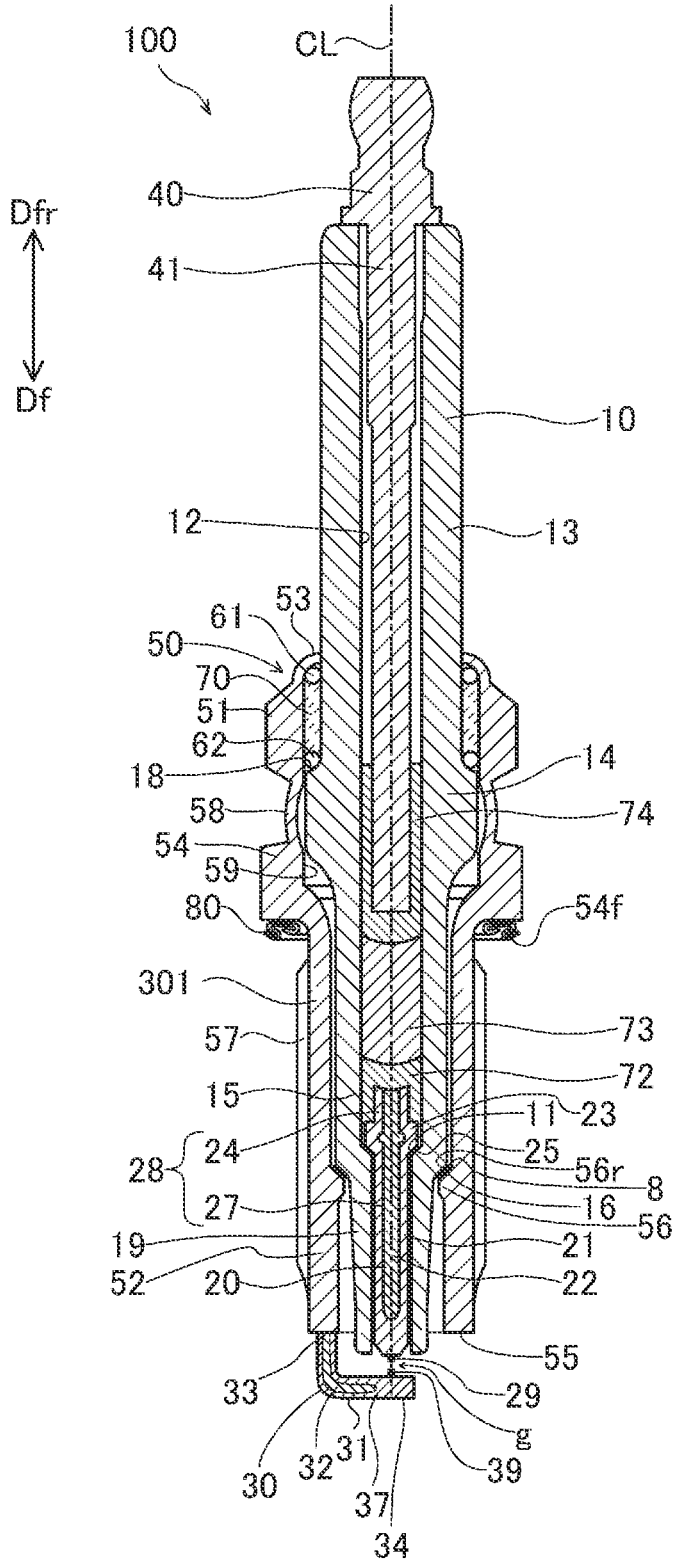
FIG. 1 is a sectional view of an ignition plug 100 according to a first embodiment of the present invention.

FIG. 1 is a sectional view of an ignition plug 100 according to a first embodiment of the present invention. The drawing illustrates a center axis CL (also called "axial line CL") of the ignition plug 100, and a flat section of the ignition plug 100 which contains the center axis CL. Hereinafter, a direction in parallel with the center axis CL is called the "direction of the axial line CL" and is also called merely the "axial direction." A radial direction of a circle centered on the axial line CL may also be called a "radial direction." The radial direction is a direction perpendicular to the axial line CL. A circumferential direction of the circle centered on the axial line CL is also called merely a "circumferential direction." Regarding the direction in parallel with the center axis CL, the downward direction in FIG. 1 is called a forward-end direction Df or a forward direction Df, and the upward direction is called a rear-end direction Dfr or a rearward direction Dfr. The forward-end direction Df is directed from a metal terminal member 40 toward a center electrode 20, these members being described later. A forward-end direction Df side in FIG. 1 is called a forward-end side of the ignition plug 100, and a rear-end direction Dfr side in FIG. 1 is called a rear-end side of the ignition plug 100.

The ignition plug 100 has a tubular insulator 10 having a through hole 12 (may also be called an axial hole 12) extending from the rearward direction Df side toward the forward direction Df side, a center electrode 20 held in the through hole 12 at the forward-end side, a metal terminal member 40 held in the through hole 12 at the rear-end side, a resistor 73 disposed within the through hole 12 to be located between the center electrode 20 and the metal terminal member 40, an electrically conductive first seal 72 which is in contact with the resistor 73 and the center electrode 20 and electrically connects these members 20 and 73, an electrically conductive second seal 74 which is in contact with the resistor 73 and the metal terminal member 40 and electrically connects these members 73 and 40, a tubular metallic shell 50 fixed to the outer circumference of the insulator 10, and a ground electrode 30 whose one end is joined to an annular forward end surface 55 of the metallic shell 50 and whose other end faces the center electrode 20 with a discharge gap g formed therebetween.

The insulator 10 is a tubular member extending along the axial line CL. The insulator 10 has a large-diameter portion 14 having the largest outside diameter and formed at a central portion thereof. A rear-end-side trunk portion 13 smaller in outside diameter than the large-diameter portion 14 is connected to an end of the large-diameter portion 14 on the rearward direction Dfr side. At a connection portion 18 between the large-diameter portion 14 and the rear-end-side trunk portion 13, the outside diameter of the insulator 10 reduces gradually in the rearward direction Dfr (the connection portion 18 is also called a rear-end-side outside-diameter-reducing portion 18).

The insulator 10 has a forward-end-side trunk portion 15 smaller in outside diameter than the large-diameter portion 14 and connected to an end of the large-diameter portion 14 on the forward direction Df side. A leg portion 19 smaller in outside diameter than the forward-end-side trunk portion 15 is connected to an end of the forward-end-side trunk portion 15 on the forward direction Df side. The leg portion 19 includes the forward end of the insulator 10. At a connection portion 16 between the forward-end-side trunk portion 15 and the leg portion 19, the outside diameter of the insulator 10 reduces gradually in the forward direction Df (the connection portion 16 is also called an outer step portion 16). The forward-end-side trunk portion 15 has a first inside-diameter-reducing portion 11 formed therein. The inside diameter of the first inside-diameter-reducing portion 11 reduces gradually in the forward direction Df (the first inside-diameter-reducing portion 11 is also called the inner step portion 11).

Preferably, the insulator 10 is formed in consideration of mechanical strength, thermal strength, and electrical strength. The insulator 10 is formed, for example, by firing alumina (other electrically insulating materials can be employed).

The center electrode 20 is a rodlike metal member extending from the rearward direction Dfr side toward the forward direction Df side. A portion of the center electrode 20 located on the rearward direction Dfr side is disposed within a portion of the through hole 12 of the insulator 10 located on the forward direction Df side. The center electrode 20 has a body portion 28 and a first tip 29 joined (by, for example, laser welding) to the forward end of the body portion 28. The body portion 28 has a head portion 24 located on the rearward direction Dfr side and a rod portion 27 connected to an end of the head portion 24 on the forward direction Df side. The rod portion 27 has an approximately circular columnar shape extending in the forward direction Df. The head portion 24 has a collar portion 23 greater in outside diameter than the rod portion 27. A portion of the collar portion 23 on the forward direction Df side is a diameter-reducing portion 25 whose outside diameter reduces gradually in the forward direction Df. The diameter-reducing portion 25 is supported by the inner step portion 11 of the insulator 10. The rod portion 27 is connected to an end of the diameter-reducing portion 25 on the forward direction Df side. The first tip 29 is joined to an end of the rod portion 27 located on the forward direction Df side.

The body portion 28 has an outer layer 21 and a core 22 disposed on the inner-circumference side of the outer layer 21. The outer layer 21 is formed of a material superior in oxidation resistance to the core 22. In the present embodiment, the outer layer 21 is formed of an alloy which contains nickel as a main component. The main component means a component having the highest content (weight % (wt. %)). The core 22 is formed of a material (e.g., pure copper, or an alloy which contains copper as a main component) higher in thermal conductivity than the outer layer 21. The outer layer 21 covers a portion of the core 22 located on the forward direction Df side. The first tip 29 is joined to the outer layer 21 of the body portion 28. The first tip 29 is formed by use of a material superior to the rod portion 27 in durability against discharge (e.g., a noble metal such as iridium (Ir) or platinum (Pt)). A portion of the center electrode 20 located on the forward direction Df side and including the first tip 29 protrudes in the forward direction Df from the axial hole 12 of the insulator 10. Notably, the first tip 29 may be omitted.

The metal terminal member 40 is a rodlike member extending along the axial line CL. The metal terminal member 40 is formed by use of an electrically conductive material (e.g., a metal which contains iron as a main component). A rodlike portion 41 of the metal terminal member 40 located on the forward direction Df side is disposed in a portion of the axial hole 12 of the insulator 10, which portion is located on the rearward direction Dfr side.

The resistor 73 in the through hole 12 of the insulator 10 is a member for suppressing electrical noise. The resistor 73 is formed by use of, for example, a mixture of glass, an electrically conductive material (e.g., carbon particles), and ceramic particles. The seals 72 and 74 are formed by use of a mixture of an electrically conductive material (e.g., metal particles such as copper particles or iron particles) and glass. The center electrode 20 is electrically connected to the metal terminal member 40 through the first seal 72, the resistor 73, and the second seal 74.

The metallic shell 50 is a tubular member having a through hole 59 extending along the axial line CL. The insulator 10 is disposed in the through hole 59 of the metallic shell 50 and is fixed to an inner-circumference side of the metallic shell 50. The metallic shell 50 is formed by use of an electrically conductive material (e.g., a metal such as carbon steel containing iron as a main component). A portion of the insulator 10 located on the forward direction Df side protrudes outward from the through hole 59. Also, a portion of the insulator 10 located on the rearward direction Dfr side protrudes outward from the through hole 59.

The metallic shell 50 has a tool engagement portion 51, an outward protruding portion 54, and a forward-end-side trunk portion 52. The tool engagement portion 51 allows an ignition plug wrench (not shown) to be fitted thereto. The outward protruding portion 54 is a flange-like portion disposed on the forward direction Df side of the tool engagement portion 51 and protruding radially outward. A surface 54*f* of the outward protruding portion 54 located on the forward direction Df side is a seating surface (also called a metallic-shell seating surface 54*f* or merely called a seating surface 54*f*) and provides a seal in cooperation with a hole formation portion (e.g., a portion of the engine head) which is a portion of an internal combustion engine and has a mounting hole. The forward-end-side trunk portion 52 is connected to an end of the outward protruding portion 54 on the forward direction Df side and includes the forward end surface 55 of the metallic shell 50. The forward-end-side trunk portion 52 has a threaded portion 57 formed externally on its outer circumferential surface and adapted to be threadingly engaged with an unillustrated mounting hole of the internal combustion engine (also called an external thread portion 57). The axial line CL is a center axis of the external thread of the threaded portion 57. The external thread of the threaded portion 57 extends along the axial line CL.

An annular gasket 80 is disposed between the seating surface 54*f* of the outward protruding portion 54 and the threaded portion 57 of the forward-end-side trunk portion 52. The gasket 80 is attached to the metallic shell 50 in contact with the seating surface 54*f*. When the ignition plug 100 is mounted to the engine head, the gasket 80 is crushed to deform. As a result of the deformation of the gasket 80, a gap between the ignition plug 100 and the engine head is sealed. The gasket 80 is formed of, for example, a metal such as iron.

The forward-end-side trunk portion 52 of the metallic shell 50 has an inward protruding portion 56 located on its inner-circumference side and protruding radially inward. A portion 56*r* of the inward protruding portion 56 located on the rearward direction Dfr side reduces in inside diameter gradually in the forward direction Df. A forward-end-side packing 8 is held between the portion 56*r* and the outer step portion 16 of the insulator 10. The portion 56*r* indirectly supports the outer step portion 16 of the insulator 10. Hereinafter, the portion 56*r* may also be called the support portion 56*r*.

The metallic shell 50 has a rear end portion 53 which is located on the rear side of the tool engagement portion 51, forms the rear end of the metallic shell 50, and is smaller in wall thickness than the tool engagement portion 51. The metallic shell 50 also has a connection portion 58 formed between the outward protruding portion 54 and the tool engagement portion 51 for connecting the portions 54 and 51. The connection portion 58 is smaller in wall thickness than the outward protruding portion 54 and the tool engagement portion 51. Annular ring members 61 and 62 are inserted between an inner circumferential surface of the metallic shell 50 extending from the tool engagement portion 51 to the rear end portion 53 and an outer circumferential surface of a portion of the insulator 10 located on the rearward direction Dfr side of the outside-diameter-reducing portion 18. Further, powder of talc 70 is charged between these ring members 61 and 62. In the manufacturing process of the ignition plug 100, when the rear end portion 53 is bent radially inward for crimping, the connection portion 58 is deformed; as a result, the metallic shell 50 and the insulator 10 are fixed together. In this crimping step, the talc 70 is compressed, thereby enhancing airtightness between the metallic shell 50 and the insulator 10. The packing 8 is pressed between the outer step portion 16 of the insulator 10 and the inward protruding portion 56 of the metallic shell 50, thereby providing a seal between the metallic shell 50 and the insulator 10. In this manner, the insulator 10 is held between the inward protruding portion 56 of the metallic shell 50 and the rear end portion 53 of the metallic shell 50.

The ground electrode 30 is a metal member and has a rodlike body portion 37 and a second tip 39 attached to a distal end portion 34 of the body portion 37. The other end portion 33 (also called the proximal end portion 33) of the body portion 37 is joined (e.g., by resistance welding) to the forward end surface 55 of the metallic shell 50. The body portion 37 extends in the forward-end direction Df from the proximal end portion 33 joined to the metallic shell 50, is bent toward the center axis CL, extends in a direction intersecting with the axial line CL, and reaches the distal end portion 34. The body portion 37 has an outer layer 31 and an inner layer 32 disposed on the inner-circumference side of the outer layer 31. The outer layer 31 is formed of a material (e.g., an alloy which contains nickel as a main component) superior to the inner layer 32 in oxidization resistance. The inner layer 32 is formed of a material (e.g., pure copper, or an alloy which contains copper as a main component) higher in thermal conductivity than the outer layer 31.

The second tip 39 is fixed to the distal end portion 34 (for example, by resistance welding or laser welding) at a position located on the rearward direction Dfr side. The second tip 39 of the ground electrode 30 is disposed on the forward direction Df side of the first tip 29 of the center electrode 20. The second tip 39 of the ground electrode 30 and the first tip 29 of the center electrode 20 define the discharge gap g. The second tip 39 is formed by use of a material superior to the body portion 37 in durability against discharge (e.g., a noble metal such as iridium (Ir) or platinum (Pt)). Notably, the second tip may be omitted. The inner layer 32 may also be omitted.

Figure 2A:
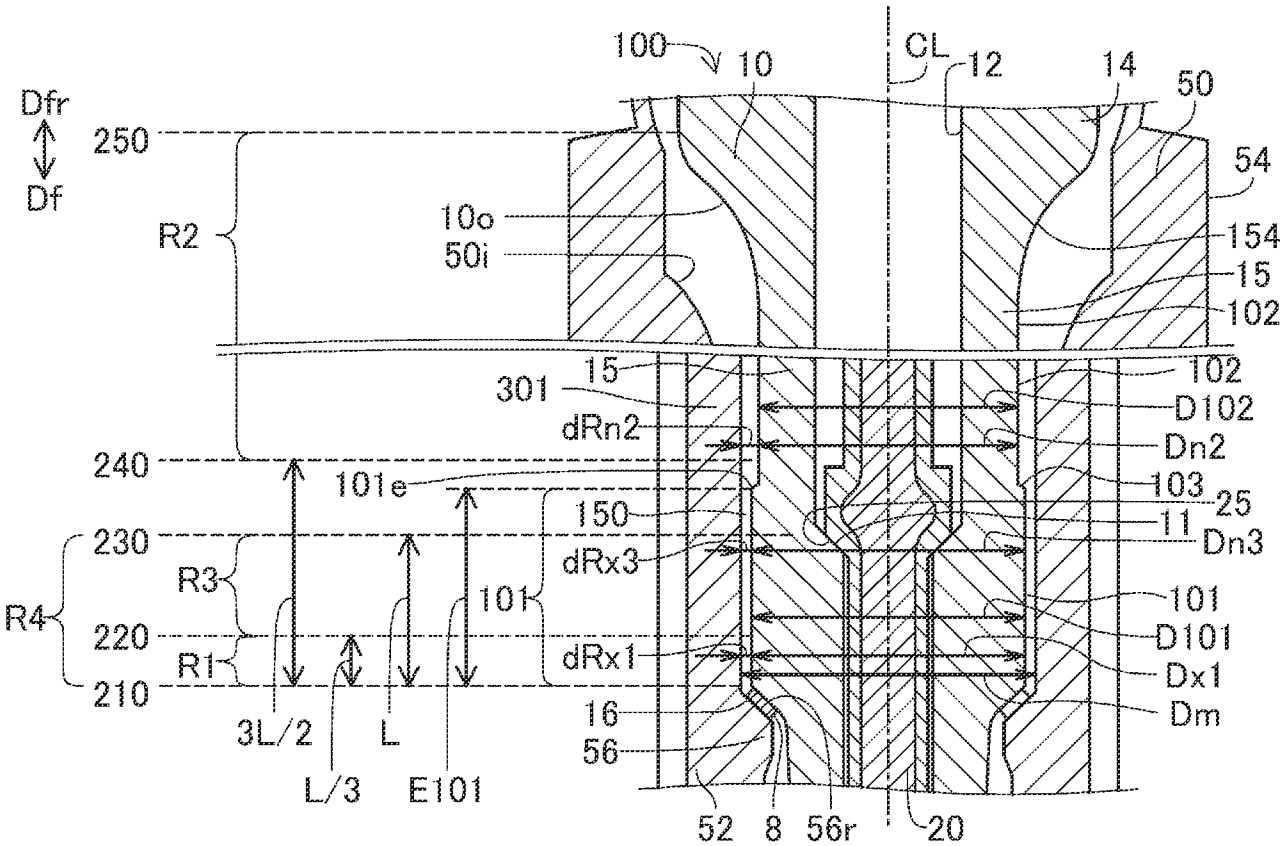
FIGS. 2A to 2C are explanatory views of an insulator 10 and a metallic shell 50.
Figure 2C:
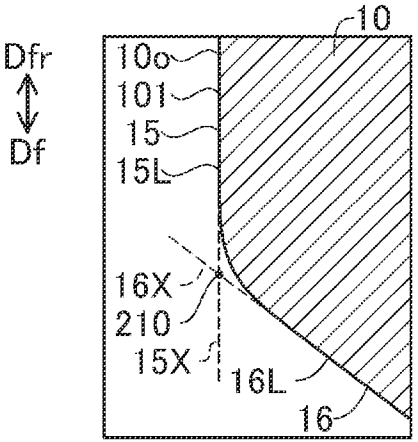
Figure 2B:
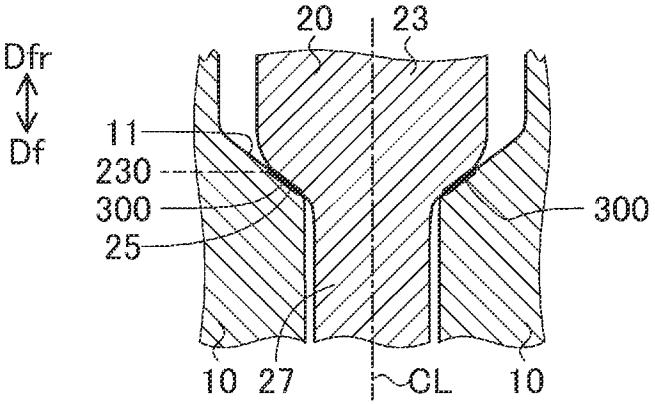

FIGS. 2A to 2C are explanatory views for explaining the relation between the insulator 10 and the metallic shell 50. FIG. 2A is a sectional view showing a portion of the ignition plug 100. The illustrated section contains the center axis CL. The section is in parallel with the center axis CL. FIG. 2A shows a portion of the center electrode 20 including the diameter-reducing portion 25 and a portion of the insulator 10 including the large-diameter portion 14, in a range from the inward protruding portion 56 to the outward protruding portion 54 of the metallic shell 50. Notably, FIG. 2A omits illustration of members disposed in the through hole 12 of the insulator 10 except the center electrode 20.

In the present embodiment, the forward-end-side trunk portion 15 of the insulator 10 includes a first portion 101 connected to an end of the outer step portion 16 on the rearward direction Dfr side, a second portion 102 located on the rearward direction Dfr side of the first portion 101, and a connection portion 103 connecting the first portion 101 and the second portion 102. The outer circumferential surfaces of the first portion 101 and the second portion 102 have a cylindrical shape whose center axis coincides with the center axis CL. The first portion 101 has a first outside diameter D101, and the second portion 102 has a second outside diameter D102. In the present embodiment, D101>D102. The outside diameter of the connection portion 103 reduces stepwise in the rearward direction Dfr.

The forward-end-side trunk portion 52 of the metallic shell 50 includes a tubular portion 301 connected to an end of the support portion 56*r* on the rearward direction Dfr side. As shown in FIG. 1, the tubular portion 301 extends from the support portion 56*r* to the vicinity of the outward protruding portion 54. The inner circumferential surface of the tubular portion 301 has a cylindrical shape whose center axis coincides with the center axis CL. The tubular portion 301 has an inside diameter Dm. The tubular portion 301 is disposed on the outer-circumference side of the portions 101, 102, and 103 of the insulator 10.

FIG. 2A shows five positions 210 to 250 along the axial line CL at the left thereof. These positions will next be described.

FIG. 2B is a sectional view partially showing the center electrode 20 and the insulator 10, including the collar portion 23 of the center electrode 20 and the first inside-diameter-reducing portion 11 of the insulator 10. The section contains the center axis CL and is in parallel with the center axis CL. The drawing omits illustration of the internal structure of the center electrode 20. The diameter-reducing portion 25 of the center electrode 20 is supported by the first inside-diameter-reducing portion 11 of the insulator 10. The contact region 300 illustrated with a bold line is where the diameter-reducing portion 25 of the center electrode 20 and the first inside-diameter-reducing portion 11 of the insulator 10 come into contact with each other. A rear end position 230 is the position of an end of the contact region 300 located on the rearward direction Dfr side (the rear end position 230 is also called a third position 230).

FIG. 2C is a sectional view of a connection portion between the forward-end-side trunk portion 15 and the outer step portion 16 of the insulator 10. The section contains the center axis CL and is in parallel with the center axis CL. The position 210 is the position of the boundary between the forward-end-side trunk portion 15 and the outer step portion 16, in relation to the direction of the axial line CL (also called a boundary position 210 or a first position 210). A boundary portion of an outer circumferential surface 10*o* of the insulator 10 between the forward-end-side trunk portion 15 and the outer step portion 16 may be radiused. In this case, the boundary position 210 is specified by the following method. In the section of FIG. 2C, a straight-line portion 15L of the forward-end-side trunk portion 15 is contained in a portion indicative of the forward-end-side trunk portion 15 of a line indicative of the outer circumferential surface 10*o* of the insulator 10 and is located closest to the outer step portion 16. A first imaginary straight line 15X is an extension of the straight-line portion 15L. A straight-line portion 16L of the outer step portion 16 is contained in a portion indicative of the outer step portion 16 of the line indicative of the outer circumferential surface 10*o* and is located closest to the forward-end-side trunk portion 15. A second imaginary straight line 16X is an extension of the straight-line portion 16L. The boundary position 210 is an intersection of the imaginary straight lines 15X and 16X.

As shown in FIG. 2A, the rear end position 230 is located on the rearward direction Dfr side of the boundary position 210. A fourth range R4 ranges from the boundary position 210 to the rear end position 230. A distance L is from the boundary position 210 to the rear end position 230 along the axial line CL. A second position 220 is located on the rearward direction Dfr side of the boundary position 210, and the distance from the second position 220 to the boundary position 210 along the axial line CL is L/3. A first range R1 ranges from the boundary position 210 to a position whose distance from the boundary position 210 along the axial line CL is L/3; specifically, from the boundary position 210 to the second position 220. A first outside diameter Dx1 is the largest outside diameter of the insulator 10 in the first range R1 (the first outside diameter Dx1 may also be called the first largest outside diameter Dx1). A third range R3 is located on the rearward direction Dfr side of a position which is located on the rearward direction Dfr side of the boundary position 210 and whose distance from the boundary position 210 along the axial line CL is L/3, the third range R3 being on the forward direction Df side of a position which is located on the rearward direction Dfr side of the boundary position 210 and whose distance from the boundary position 210 along the axial line CL is L. Specifically, the third range R3 is a remaining range after eliminating the second position 220 from a range from the second position 220 to the rear end position 230. A third outside diameter Dn3 is the smallest outside diameter of the insulator 10 in the third range R3 (the third outside diameter Dn3 may also be called the third smallest outside diameter Dn3).

A fourth position 240 is located on the rearward direction Dfr side of the boundary position 210 at a distance of 3L/2 from the boundary position 210 along the axial line CL. A fifth position 250 is the position of an end of the large-diameter portion 14 located on the forward direction Df side. As shown at the upper right of FIG. 2A, a connection portion 154 is connected to an end of the large-diameter portion 14 on the forward direction Df side, and the second portion 102 is connected to an end of the connection portion 154 on the forward direction Df side. At the connection portion 154, the outside diameter reduces gradually in the forward direction Df. Notably, the connection portion 154 and the second portion 102 partially constitute the forward-end-side trunk portion 15.

A second range R2 is located on the rearward direction Dfr side of a position which is located on the rearward direction Dfr side of the boundary position 210 and whose distance from the boundary position 210 is 3L/2, the second range R2 being located on the forward direction Df side of the large-diameter portion 14. Specifically, the second range R2 is a remaining range after eliminating the fourth position 240 and the fifth position 250 from a range from the fourth position 240 to the fifth position 250. A second outside diameter Dn2 is the smallest outside diameter of the insulator 10 in the second range R2 (the second outside diameter Dn2 may also be called the second smallest outside diameter Dn2).

FIG. 2A shows a rear end 101*e* of the first portion 101 located on the rearward direction Dfr side, and a length E101 of the first portion 101 along the axial line CL. The length E101 is from the boundary position 210 to the rear end 101*e*.

As illustrated, a gap 150 is formed between an inner circumferential surface 50*i* of the metallic shell 50 and the outer circumferential surface 10*o* of the insulator 10. Widths dRx1, dRn2, and dRx3 are radial widths of the gap 150. The first width dRx1 is the largest width of the gap 150 in the first range R1 (the first width dRx1 may also be called the first largest width dRx1). The second width dRn2 is the smallest width of the gap 150 in the second range R2 (the second width dRn2 may also be called the second smallest width dRn2). The third width dRx3 is the largest width of the gap 150 in the third range R3 (the third width dRx3 may also be called the third largest width dRx3).

In the structure of FIG. 2A, the rear end 101*e* of the first portion 101 is located between the rear end position 230 of the contact region 300 (FIG. 2B) and the fourth position 240. As will be described later, the rear end 101*e* of the first portion 101 may be located at another position (e.g., within the third range R3). In the structure of FIG. 2A, the first largest outside diameter Dx1 is identical with the outside diameter D101 of the first portion 101; the second smallest outside diameter Dn2 is identical with the outside diameter D102 of the second portion 102; and the third smallest outside diameter Dn3 is identical with the outside diameter D101 of the first portion 101. Also, the first largest width dRx1 is (Dm−D101)/2; the second smallest width dRn2 is (Dm−D102)/2; and the third largest width dRx3 is (Dm−D101)/2. Notably, as shown in FIG. 2C, a boundary portion of the outer circumferential surface 10*o* of the insulator 10 between the forward-end-side trunk portion 15 and the outer step portion 16 may be radiused. In this case, the width of the gap 150 in the first range R1 (FIG. 2A) may become largest at or in the vicinity of the boundary position 210. In any case, in the present embodiment, the first largest width dRx1 is smaller than the second smallest width dRn2. This is for the following reason.

The ignition plug 100 may be mounted in a mounting hole of an internal combustion engine (not shown). A portion of the center electrode 20 located on the forward direction Df side may come into contact with combustion gas. Because of reception of heat from combustion gas, the temperature of the center electrode 20 may increase. The high-temperature center electrode 20 may deteriorate the heat resistance performance of the ignition plug 100. For example, the high-temperature center electrode 20 may initiate preignition. In the present embodiment, the center electrode 20 is cooled in the following manner. Heat that the center electrode 20 receives from combustion gas is transmitted to the insulator 10 through the diameter-reducing portion 25 of the center electrode 20 and the first inside-diameter-reducing portion 11 of the insulator 10. Heat that the insulator 10 receives from the center electrode 20 is transmitted to the metallic shell 50 through the outer step portion 16 of the insulator 10, the forward-end-side packing 8, and the support portion 56*r* of the metallic shell 50. Heat that the metallic shell 50 receives is transmitted to an unillustrated internal combustion engine through the externally threaded portion 57 of the metallic shell 50.

In this way, the temperature of a portion of the insulator 10 in the fourth range R4 ranging from the first position 210 to the third position 230 is apt to increase as a result of reception of heat from the center electrode 20. In the case where the first largest width dRx1 in the first range R1, which is a forward direction Df side portion of the fourth range R4, is small, in the first range R1, heat is easily conducted from the outer circumferential surface 10*o* of the insulator 10 to the inner circumferential surface 50*i* of the metallic shell 50 through the gap 150. Therefore, cooling of the center electrode 20 is accelerated, thereby restraining deterioration in the heat resistance performance of the ignition plug 100. If deterioration in heat resistance performance is restrained, the length of the leg portion 19 along the axial line CL can be increased, thereby restraining discharge along the surface of the leg portion 19. Further, in the structure of FIG. 2A, the third largest width dRx3 in the third range R3, which is a rearward direction Dfr side portion of the fourth range R4, is identical with the first largest width dRx1. Therefore, in the third range R3, heat is easily conducted from the outer circumferential surface 10*o* of the insulator 10 to the inner circumferential surface 50*i* of the metallic shell 50 through the gap 150. Therefore, cooling of the center electrode 20 is accelerated, thereby restraining deterioration in the heat resistance performance of the ignition plug 100. Notably, in the present embodiment, the width of the gap 150 defined by the first portion 101 of the insulator 10 is narrower than the width of the gap 150 defined by the second portion 102. Therefore, the longer the length E101 of the first portion 101, the greater the acceleration of heat conduction through the gap 150.

In the case where the second smallest width dRn2 in the second range R2, which is located on the rearward direction Dfr side of the fourth range R4, is large, work of fixing the metallic shell 50 and the insulator 10 together can be facilitated. For example, contact between the outer circumferential surface 10*o* of the insulator 10 and the inner circumferential surface 50*i* of the metallic shell 50 is restrained. Therefore, accidental scratching of the insulator 10 is restrained. Also, the ignition plug 100 attached to an engine may vibrate. In the event of vibration of the ignition plug 100, unintentional contact between the insulator 10 and the metallic shell 50 is restrained. As a result, breakage of the insulator 10 is restrained.

Figure 3:
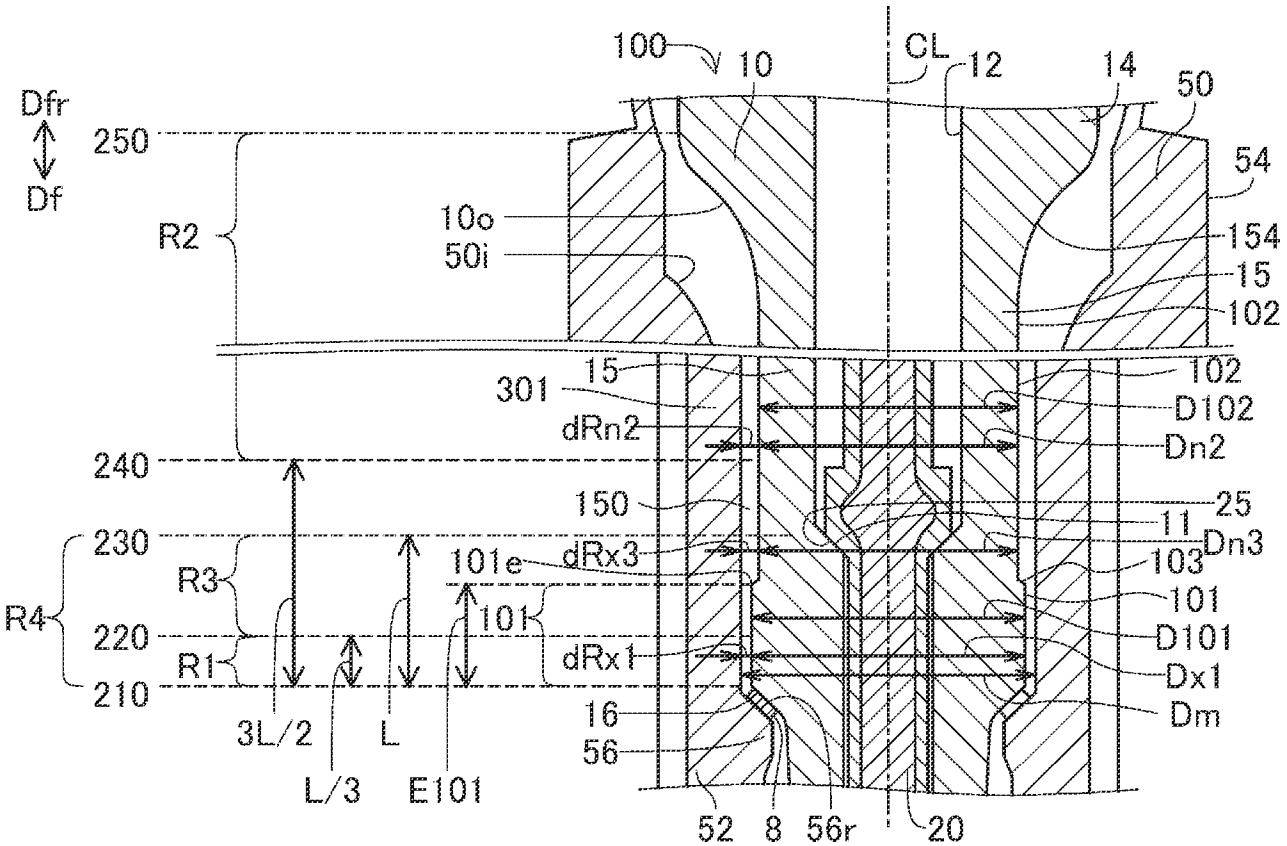
FIG. 3 is an explanatory view for explaining another structure of the ignition plug 100.

FIG. 3 is an explanatory view for explaining another structure of the ignition plug 100. FIG. 3 shows a sectional view of the same portion as that shown in FIG. 2A. The structure of FIG. 3 differs from that of FIG. 2A only in disposition of the rear end 101*e* of the first portion 101 of the forward-end-side trunk portion 52 of the insulator 10 within the third range R3. Other structural elements of the ignition plug 100 are similar to corresponding elements of the ignition plug 100 in FIG. 2A (like elements are denoted by like reference numerals, and repeated description thereof is omitted).

In the structure of FIG. 3, the third largest width dRx3 of the gap 150 in the third range R3 is (Dm−D102)/2. As compared with the structure of FIG. 2A, the third largest width dRx3 is large. Therefore, in manufacture of the ignition plug 100, unintentional contact between the outer circumferential surface 10*o* of the insulator 10 and the inner circumferential surface 50*i* of the metallic shell 50 is further restrained. As a result, accidental scratching of the insulator 10 is restrained. Also, in the event of vibration of the ignition plug 100, unintentional contact between the insulator 10 and the metallic shell 50 is restrained. As a result, breakage of the insulator 10 is restrained.

Notably, in the structure of FIG. 3, similar to the structure of FIG. 2A, the first largest width dRx1 is smaller than the second smallest width dRn2. In the case where the first largest width dRx1 is small, in the first range R1, heat is easily conducted from the outer circumferential surface 10*o* of the insulator 10 to the inner circumferential surface 50*i* of the metallic shell 50 through the gap 150. Therefore, cooling of the center electrode 20 is accelerated, thereby restraining deterioration in the heat resistance performance of the ignition plug 100. In the case where the second smallest width dRn2 in the second range R2 is large, work of fixing the metallic shell 50 and the insulator 10 together can be facilitated.

B. Evaluation Test

B-1. First Evaluation Test:

FIG. 4A is a first table TA showing the correspondence of structural parameters to test results with respect to ignition plug samples. The first table TA shows the correspondence of sample Nos., the first largest outside diameter Dx1, the second smallest outside diameter Dn2, and the ratio (Dn2/Dx1) to evaluation results. In the evaluation test, five types of sample Nos. A1 to A5 were tested. The five types of samples have the same first largest outside diameter Dx1 of 6.25 (mm). Sample Nos. A1 to A5 have a smallest outside diameter Dn2 of 6.2, 6, 5.8, 5.6, and 5.4 (mm), respectively.

Sample Nos. A1 to A5 have a ratio (Dn2/Dx1) of 0.992, 0.960, 0.928, 0.896, and 0.864, respectively. Notably, in the samples of the present evaluation test, the first largest outside diameter Dx1 is identical with the first outside diameter D101 of the first portion 101. The second smallest outside diameter Dn2 is identical with the second outside diameter D102 of the second portion 102. Since the second smallest outside diameter Dn2 is smaller than the first largest outside diameter Dx1, the ratio (Dn2/Dx1) is less than 1. Although unillustrated, in the samples, the nominal size of the external thread portion 57 (FIG. 1) is M10 (10 mm). In the samples, the distance from the metallic-shell seating surface 54*f* to the forward end surface 55 of the metallic shell 50 along the axial line CL is 26.5 mm. Also, the ignition plug samples used in the present evaluation test have the structure of FIG. 2A.

The test method is as described below. The ignition plug samples are manufactured by a publicly known method. The manufacturing method is, for example, as follows. The insulator 10, the center electrode 20, the rodlike ground electrode 30, the metal terminal 40, and the metallic shell 50 are manufactured by publicly known methods, respectively. Material powders for the seals 72 and 74 and a material powder for the resistor 73 are prepared. The center electrode 20, the material powder for the first seal 72, the material powder for the resistor 73, and the material powder for the second seal 74 are inserted in this order into the through hole 12 of the insulator 10 from the rearward direction Dfr side opening. While the insulator 10 is heated, the metal terminal 40 is inserted into the through hole 12 from the rearward direction Dfr side opening. As a result, the material powders for the members 72, 73, and 74 are compressed and sintered, thereby forming the members 72, 73, and 74. Also, the metal terminal 40 is fixed to the insulator 10.

The rodlike ground electrode 30 is joined to the metallic shell 50. The insulator 10 is fixed to the metallic shell 50. Specifically, the forward-end-side packing 8, the insulator 10, the ring member 62, the talc 70, and the ring member 61 are disposed in the through hole 59 of the metallic shell 50. The forward-end-side packing 8 is held between the support portion 56*r* of the metallic shell 50 and the outer step portion 16 of the insulator 10. By bending inward the rear end portion 53 of the metallic shell 50 for crimping, the metallic shell 50 and the insulator 10 are fixed together. The second tip 39 is joined to the body portion 37 of the ground electrode 30. The rodlike ground electrode 30 is bent, thereby forming the gap g. The ignition plug is thus completed.

After completion of the ignition plug, the ignition plug is disassembled. The connection portion 103 (FIGS. 2A and 3) of the insulator 10 is observed. When the rear end portion 53 of the metallic shell 50 is crimped, force is transmitted to the insulator 10. Since, at the connection portion 103 of the insulator, the outside diameter 10 changes, stress may concentrate at the connection portion 103. The stress may cause fissuring in the connection portion 103. Evaluation A indicates that the connection portion 103 is free from fissuring. Evaluation B indicates that the connection portion 103 suffers fissuring.

As shown in the first table TA (FIG. 4A) , the samples having a high ratio (Dn2/Dx1) are evaluated favorably. Presumably, this is for the following reason: the smaller the outside diameter difference at the connection portion 103; i.e., the higher the ratio (Dn2/Dx1), the smaller the stress developing in the connection portion 103. Specifically, the ratios of sample Nos. A1 to A4 having evaluation A were 0.992, 0.960, 0.928, and 0.896, respectively. The ratio of Sample A5 having evaluation B was 0.864.

A preferred range of the ratio (Dn2/Dx1) may be determined by use of four values of sample Nos. A1 to A4 having good evaluation. Specifically, any one of the four values may be employed as the lower limit of the preferred range of the ratio. For example, the ratio may be equal to or greater than 0.896, which is the smallest value of the four values. Also, as mentioned above, the higher the ratio, the lower the possibility of fissuring. The ratio may be equal to or greater than 0.9, which is greater than the smallest value. Also, any one of the four values equal to or greater than the lower limit may be employed as the upper limit of the ratio. For example, the ratio may be equal to or lower than 0.992. Notably, the higher the ratio (i.e., the closer to 1 the ratio), the greater the extent to which fissuring in the insulator 10 is restrained. Therefore, the ratio may be any value less than 1. For example, preferably, the ratio satisfies a relation of $0.9 \leq Dn2/Dx1 < 1$.

B-2. Second Evaluation Test:

FIG. 4B is a second table TB showing correspondence between structural parameters and test results with respect to ignition plug samples. The second table TB shows the correspondence of the inside diameter Dm of the tubular portion 301 of the metallic shell 50, the first largest outside diameter Dx1 of the insulator 10 in the first range R1, the diameter difference dD (Dm−Dx1), and the length E101 of the first portion 101 to evaluation results of heat resistance performance and evaluation results of durability. In the evaluation test, 14 types of sample Nos. B1 to B14 were tested. Sample Nos. B1 to B14 have an inside diameter Dm of 6.55, 6.5, 6.45, 6.45, 6.45, 6.45, 6.45, 6.4, 6.35, 6.3, 6.3, 6.3, 6.3, and 6.3 (mm), respectively. The inside diameters Dm of sample Nos. B8 to B14 are obtained by subtracting 0.15 mm from the inside diameters Dm of sample Nos. B1 to B7, respectively. The 14 types of samples have the same first outside diameter Dx1 of 6.25 (mm). Sample Nos. B1 to B14 have a diameter difference dD of 0.3, 0.25, 0.2, 0.2, 0.2, 0.2, 0.2, 0.15, 0.1, 0.05, 0.05, 0.05, 0.05, and 0.05 (mm), respectively. Sample Nos. B1 to B14 have a length E101 of 1.8, 1.8, 0.3, 0.6, 1.8, 2.7, 3.6, 1.8, 1.8, 0.3, 0.6, 1.8, 2.7, and 3.6 (mm). The lengths E101 of sample Nos. B1 to B7 are identical with those of sample Nos. B8 to B14, respectively. Notably, in the column of the length E101 of the second table TB, the length E101 expressed in units of distance L is shown on the right-hand side. The 14 types of samples have the same distance L of 1.8 (mm). Although unillustrated, in the samples, the nominal size of the external thread portion 57 (FIG. 1) is M10 (10 mm). In the samples, the distance from the metallic-shell seating surface 54*f* to the forward end surface 55 of the metallic shell 50 along the axial line CL is 26.5 mm. The 14 types of samples have the same second smallest outside diameter Dn2 of 6 (mm).

The test method for heat resistance performance is as described below. Ignition plug samples of the same type were attached to a straight 4-cylinder direct-injection engine of 1.6 L displacement with a supercharger; then, the engine was operated. In this condition, ignition timing was advanced from the regular ignition timing to identify an ignition timing at which preignition occurred (also called preignition occurred advance angle AG). The larger the preignition occurred advance angle AG, the less likely the occurrence of preignition; i.e., heat resistance performance is good. Notably, the operating conditions of the engine are common to the 14 types of samples. Evaluation results were determined as follows by using sample No. B1 as a reference. Evaluation A indicates that the preignition occurred advance angle of a sample is large as compared with that of sample No. B1 such that the difference in preignition occurred advance angle is 2 degrees or more. Evaluation B indicates that the preignition occurred advance angle of a sample is large as compared with that of sample No. B1 such that the difference in preignition occurred advance angle is equal to or greater than 1 degree and less than 2 degrees. Evaluation C indicates that the difference obtained by subtracting the preignition occurred advance angle of sample No. B1 from that of a sample is less than 1 degree.

The evaluation method for durability is as described below. In the above-mentioned heat resistance performance test, the temperature of a portion of the insulator 10 in the fourth range R4 ranging from the boundary position 210 to the rear end position 230 is apt to increase. By contrast, the temperature of the outer step portion 16 in contact with the forward-end-side packing 8 is apt to drop. This temperature difference may cause minor cracking in the outer circumferential surface 10*o* of the insulator 10 or may cause the insulator 10 to fissure. After the heat resistance performance test, the ignition plug samples were disassembled to inspect the insulators 10. Evaluation Y indicates that a fissure was detected from one or more samples out of four samples of the same type attached to the engine. Whether or not a fissure was present was visually determined. Evaluation X indicates that a fissure was not detected from the four samples, and a crack was detected from one or more samples. Whether or not a crack was present was determined by liquid penetrant examination. Since cracking to be detected is minor cracking only in the outer circumferential surface 10*o* of the insulator 10, such cracking has no adverse effect on the performance of the ignition plug 100. The blank indicates that neither crack nor fissure was detected from the four samples.

As shown in the second table TB, the samples whose heat resistance performance was evaluated as C were three types of sample Nos. B2, B3, and B10. Sample No. B2 had a diameter difference dD of 0.25 (mm) and a length E101 of L. Sample Nos. B3 and B10 had a diameter difference dD of 0.2 and 0.05 (mm), respectively, and a length E101 of (1/6)L. The samples having good heat resistance performance of evaluation B or higher were 10 types of sample Nos. B4 to B9 and B11 to B14. The samples having good heat resistance performance had a diameter difference dD of 0.2, 0.15, 0.1, or 0.05 (mm). The samples having good heat resistance performance had a length E101 of (1/3)L, L, (3/2)L, or 2L. As seen from the above, in the case where the diameter difference dD is small, as compared with the case where the diameter difference dD is large, heat resistance performance was good. Presumably, this is for the following reason: in the case where the diameter difference dD is small, as compared with the case where the diameter difference dD is large, heat conduction through the gap 150 is accelerated. Also, in the case where the length E101 of the first portion 101 is long, as compared with the case where the length E101 is short, heat resistance performance was good. Presumably, this is for the following reason: in the case where the length E101 is long, as compared with the case where the length E101 is short, heat conduction through the gap 150 between the metallic shell 50 and the first portion 101 of the insulator 10 is accelerated.

As seen from the above, heat resistance performance is improved in the case where the length E101 of the first portion 101 is long and the diameter difference dD is small. The samples having good heat resistance performance of evaluation B or higher have a length E101 of (1/3)L or longer and a diameter difference dD of 0.2 (mm) or less. Such a structure can be rephrased as follows. In the first range R1 (FIG. 2A and FIG. 3), the difference between the inside diameter of the metallic shell 50 and the outside diameter of the insulator 10 is 0.2 mm or less. The employment of such a structure can improve the heat resistance performance of the ignition plug 100.

Notably, as described with reference to FIG. 2C, in the case where the connection portion between the forward-end-side trunk portion 15 and the outer step portion 16 is radiused, in the vicinity of the boundary position 210, the outside diameter of the insulator 10 may become smaller than the first outside diameter D101. In the case of sample Nos. B1 to B14, the degree of radiusing was sufficiently small such that a largest difference between the inside diameter of the metallic shell 50 and the outside diameter of the insulator 10 in the first range R1 was identical with the diameter difference dD.

Notably, the closer to zero the width of the gap 150, the greater the acceleration of heat conduction through the gap 150. Therefore, the width of the gap 150 and, in turn, the difference between the inside diameter of the metallic shell 50 and the outside diameter of the insulator 10 may assume various values greater than zero.

Also, presumably, in the case where the width of the gap 150 is small, regardless of the inside diameter of the metallic shell 50 and the outside diameter of the insulator 10, heat conduction through the gap 150 is accelerated. Thus, the inside diameter of the metallic shell 50 and the outside diameter of the insulator 10 may assume various values.

In the samples other than sample Nos. B7 and B14, the difference between the inside diameter of the metallic shell 50 and the outside diameter of the insulator 10 in the second range R2 is greater than 0.2 mm. Specifically, a smallest diameter difference of Dm−Dn2 is 0.3 mm. Therefore, the ignition plug 100 can be easily manufactured. Also, in the event of vibration of the ignition plug 100, unintentional contact between the insulator 10 and the metallic shell 50 is restrained. Therefore, breakage of the insulator 10 can be restrained. Notably, in the case where the width of the gap 150 is large, regardless of the inside diameter of the metallic shell 50 and the outside diameter of the insulator 10, unintentional contact between the insulator 10 and the metallic shell 50 is restrained. Thus, in the second range R2, the inside diameter of the metallic shell 50 and the outside diameter of the insulator 10 may assume various values.

In the samples having good heat resistance performance of evaluation B or higher, the largest outside diameter Dx1 of the insulator 10 in the first range R1 is identical with the first outside diameter D101 of the first portion 101 of 6.25 (mm). The smallest outside diameter Dn2 of the insulator 10 in the second range R2 is identical with the second outside diameter D102 of the second portion 102 of 6 (mm). The ratio (Dn2/Dx1) is 0.96 and satisfies a relation of $0.9 \leq Dn2/Dx1 < 1$. Therefore, breakage of the connection portion 103 between the first portion 101 and the second portion 102 of the insulator 10 can be restrained.

Notably, in the case where the ratio (Dn2/Dx1) is close to 1, regardless of the values of the first outside diameter Dx1 and the second outside diameter Dn2, the amount of change in outside diameter at the connection portion 103 is small. Therefore, presumably, in the case of satisfaction of a relation of $0.9 \leq Dn2/Dx1 < 1$, regardless of the values of the first outside diameter Dx1 and the second outside diameter Dn2, the connection portion 103 has good durability. Thus, the first outside diameter Dx1 and the second outside diameter Dn2 may assume various values that satisfy the relation of $0.9 \leq Dn2/Dx1 < 1$.

The samples having heat resistance performance of evaluation A were five types of sample Nos. B9 and B11 to B14. The samples had a diameter difference dD of 0.1 or 0.05 (mm). Such a structure can be rephrased as follows. In the first range R1, the difference between the inside diameter of the metallic shell 50 and the outside diameter of the insulator is 0.1 (mm) or less. Since the employment of such a structure further accelerates heat conduction through the gap 150, heat resistance performance can be improved. Notably, the difference between the inside diameter of the metallic shell 50 and the outside diameter of the insulator 10 may be 0.1 (mm) or less only in a portion of the first range R1.

The four types of sample Nos. B11 to B14 had a diameter difference dD of 0.05 (mm). Such a structure can be rephrased as follows. In the first range R1, the difference between the inside diameter of the metallic shell 50 and the outside diameter of the insulator 10 is 0.05 (mm) or less. Since the employment of such a structure further accelerates heat conduction through the gap 150, heat resistance performance can be improved. Notably, the difference between the inside diameter of the metallic shell 50 and the outside diameter of the insulator 10 may be 0.05 (mm) or less only in a portion of the first range R1.

In order to accelerate heat conduction from the insulator 10 to the metallic shell 50 through the gap 150, preferably, the width of the gap 150 is small also in the third range R3, in addition to the first range R1. For example, in the third range R3, similar to the first range R1, the difference between the inside diameter of the metallic shell 50 and the outside diameter of the insulator 10 may be 0.2 mm or less. Of the samples having good heat resistance performance of evaluation B or higher, sample Nos. B5 to B9 and B12 to B14 have a difference between the inside diameter of the metallic shell 50 and the outside diameter of the insulator 10 of 0.2 mm or less in the third range R3. Notably, as in the case of sample Nos. B4, B10, and B11, the difference between the inside diameter of the metallic shell 50 and the outside diameter of the insulator 10 may exceed 0.2 mm in at least a portion of the third range R3.

In order to accelerate heat conduction from the insulator 10 to the metallic shell 50 through the gap 150, preferably, the gap 150 is small over the entire first range R1. For example, as in the case of sample Nos. B9 and B11 to B14 having heat resistance performance of evaluation A, preferably, the difference between the inside diameter of the metallic shell 50 and the outside diameter of the insulator 10 is 0.1 (mm) or less over the entire first range R1.

In the case of a short length E101 of the first portion 101 of the insulator 10, preferably, the gap 150 is further small over the entire first range R1. For example, of sample Nos. B9 and B11 to B14 having heat resistance performance of evaluation A, sample No. B11 differs from the other samples in that the length E101 of the first portion 101 is shorter than L. Similar to the samples having the length E101 equal to or longer than L, sample No. B11 has heat resistance performance of evaluation A. Presumably, this is for the following reason: over the entire first range R1, the difference between the inside diameter of the metallic shell 50 and the outside diameter of the insulator 10 is 0.05 (mm) or less. Thus, preferably, over the entire first range R1, the difference between the inside diameter of the metallic shell 50 and the outside diameter of the insulator 10 is 0.05 (mm) or less.

Durability of sample Nos. B7 and B14 is evaluated as Y (i.e., the insulator 10 has fissured). Durability of the other samples is evaluated as X or higher. Presumably, this is for the following reason. Sample Nos. B7 and B14 are long in the length E101 of the first portion 101 as compared with the other samples. In the case of a long first portion 101, since heat conduction from the first portion 101 to the metallic shell 50 is accelerated, the temperature difference between a high-temperature portion and a low-temperature portion of the insulator 10 may increase. As a result, the insulator 10 may fissure. In order to improve the durability of the insulator 10, preferably, the length E101 of the first portion 101 is short.

As mentioned above, a portion of the insulator 10 in the fourth range from the first position 210 to the third position 230 is apt to increase in temperature due to heat from the center electrode 20. The distance L represents the length of this portion. Presumably, the temperature difference between a high-temperature portion and a low-temperature portion of the insulator 10 is influenced greatly by the ratio of the length E101 of the first portion 101 to the distance L rather than the length E101 itself.

A preferred range of the length E101 may be determined by use of the lengths E101 of the samples having good durability (evaluation X or blank). The lengths E101 of the samples having good durability include (1/3)L, L, and (3/2)L. Any one of the three values may be employed as the upper limit of the preferred range of the length E101. For example, the length E101 may be equal to (3/2)L or less. Also, any one of the above three values equal to or less than the upper limit may be employed as the lower limit of the length E101. Alternatively, any one of the lengths E101 of the samples having heat resistance performance of evaluation B or higher may be employed as the lower limit; for example, the length E101 may be equal to or greater than (1/3)L.

C. Second Embodiment

Figure 5:
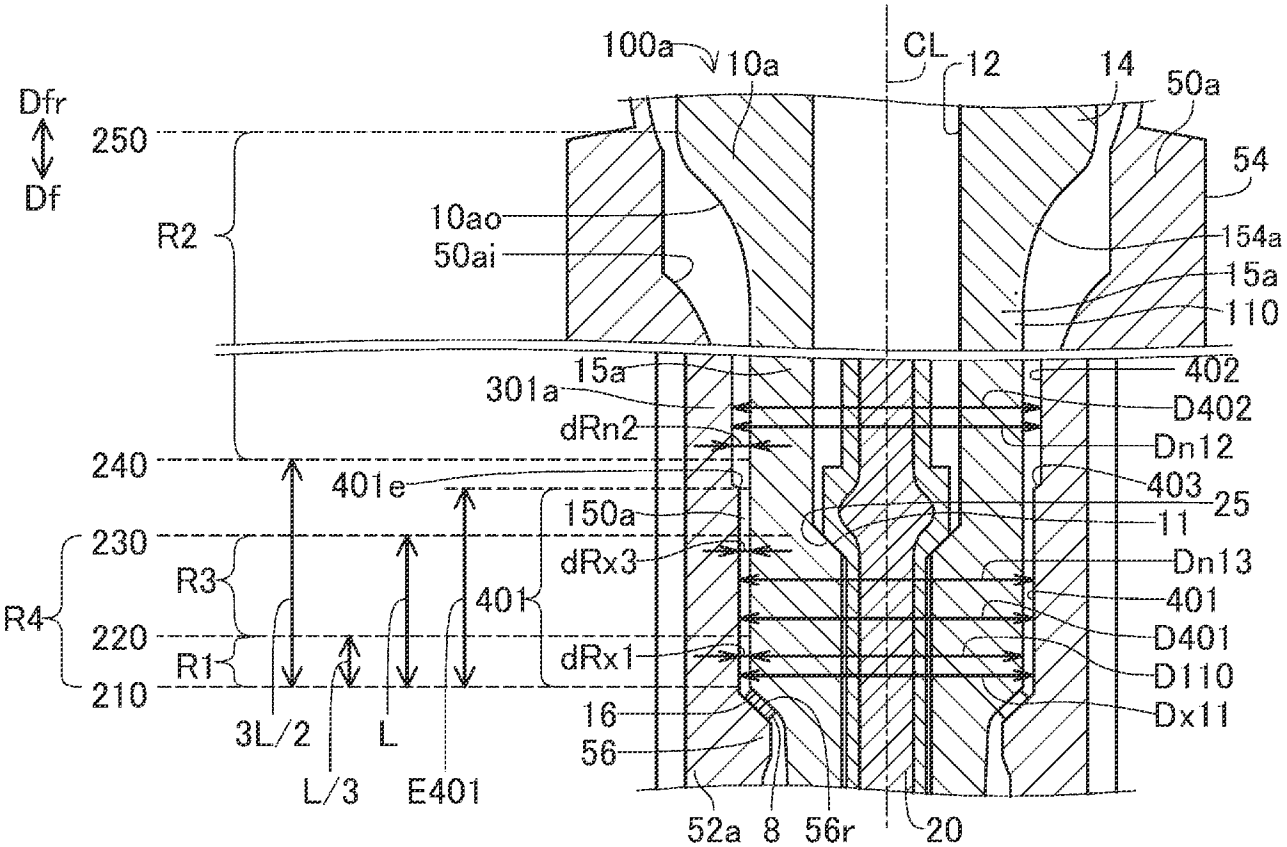
FIG. 5 is a sectional view of an ignition plug 100*a* according to a second embodiment of the present invention.

FIG. 5 is a sectional view showing the structure of an ignition plug 100*a* according to a second embodiment of the present invention. FIG. 5 shows a region of the ignition plug 100*a* corresponding to those of FIGS. 2A and 3. The illustrated section contains the center axis CL and is in parallel with the center axis CL. The second embodiment differs from the embodiment of FIGS. 2A and 3 in two points.

The first difference is that a forward-end-side trunk portion 15*a* of an insulator 10*a* includes the tubular portion 110 connected to an end of the outer step portion 16 on the rearward direction Dfr side, and a connection portion 154*a* connecting the large-diameter portion 14 and the tubular portion 110. The tubular portion 110 has a fixed outside diameter D110. The outer circumferential surface of the tubular portion 110 has a cylindrical shape whose center axis coincides with the center axis CL. The outside diameter of the connection portion 154*a* reduces gradually in the forward direction Df.

The second difference is that a tubular portion 301*a* of the forward-end-side trunk portion 52 of a metallic shell 50*a* includes a first portion 401 connected to an end of the support portion 56*r* on the rearward direction Dfr side, a second portion 402 located on the rearward direction Dfr side of the first portion 401, and a connection portion 403 connecting the first portion 401 and the second portion 402. The inner circumferential surfaces of the first portion 401 and the second portion 402 have respective cylindrical shapes whose center axes coincide with the center axis CL. A first inside diameter D401 is of the first portion 401, and a second inside diameter D402 is of the second portion 402. In the present embodiment, D401<D402. The inside diameter of the connection portion 403 increases stepwise in the rearward direction Dfr. The tubular portion 110 of the insulator 10*a* is disposed on the inner-circumference side of the tubular portion 301*a* of the metallic shell 50*a*.

Other structural elements of the ignition plug 100*a* are similar to corresponding elements of the ignition plug 100 (FIG. 2A, etc.) (like elements are denoted by like reference numerals, and repeated description thereof is omitted).

The positions 210 to 250 and the ranges R1 to R4 in FIG. 5 are identical with those described with reference to FIG. 2A. For example, the boundary position 210 indicates the boundary between the forward-end-side trunk portion 15*a* and the outer step portion 16 of the insulator 10*a*. FIG. 5 also shows a rear end 401*e* (an end located on the rearward direction Dfr side) of the first portion 401, and the length E401 of the first portion 401 along the axial line CL. The length 401 is from the boundary position 210 to the rear end 401*e*. The widths dRx1, dRn2, and dRx3 appearing in FIG. 5 are radial widths of a gap 150*a* between an outer surface 10*a* of the insulator 10*a* and an inner circumferential surface 50*ai* of the metallic shell 50*a*. A method of determining the widths dRx1, dRn2, and dRx3 is the same as the method of determining the widths dRx1, dRn2, and dRx3 described above with reference to FIG. 2A. In the structure of FIG. 5, the rear end 401*e* of the first portion 401 is located between the third position 230 and the fourth position 240. Notably, the rear end 401*e* may be located at various other positions (e.g., in the third range R3).

A first inside diameter Dx11 in FIG. 5 is the largest inside diameter of the metallic shell 50*a* in the first range R1 (the first inside diameter Dx11 may also be called the first largest inside diameter Dx11). A second inside diameter Dn12 is the smallest inside diameter of the metallic shell 50*a* in the second range R2 (the second inside diameter Dn12 may also be called the second smallest inside diameter Dn12). A third inside diameter Dn13 is the smallest inside diameter of the metallic shell 50*a* in the third range R3 (the third inside diameter Dn13 may also be called the third smallest inside diameter Dn13).

In the structure of FIG. 5, the first largest inside diameter Dx11 is identical with the first inside diameter D401 of the first portion 401; the second smallest inside diameter Dn12 is identical with the second inside diameter D402 of the second portion 402; and the third smallest inside diameter Dn13 is identical with the first inside diameter D401 of the first portion 401. Also, the first largest width dRx1 is (Dx11−D110)/2; the second smallest width dRn2 is (Dn12−D110)/2; and the third largest width dRx3 is (Dn13−D110)/2. Notably, similar to the embodiment of FIG. 2C, a boundary portion of an outer circumferential surface 10*ao* of the insulator 10*a* between the forward-end-side trunk portion 15*a* and the outer step portion 16 may be radiused. In this case, the width of the gap 150*a* in the first range R1 may become largest at or in the vicinity of the boundary position 210. In any case, in the present embodiment, the first largest width dRx1 is smaller than the second smallest width dRn2.

In the case where the first largest width dRx1 in the first range R1 is small, in the first range R1, heat is easily conducted from the outer circumferential surface 10*ao* of the insulator 10*a* to the inner circumferential surface 50*ai* of the metallic shell 50*a* through the gap 150*a*. Therefore, cooling of the center electrode 20 is accelerated, thereby restraining deterioration in the heat resistance performance of the ignition plug 100*a*. Further, in the structure of FIG. 5, the third largest width dRx3 in the third range R3, which is a rearward direction Dfr side portion of the fourth range R4, is identical with the first largest width dRx1. Therefore, in the third range R3, heat is easily conducted from the outer circumferential surface 10*ao* of the insulator 10*a* to the inner circumferential surface 50*ai* of the metallic shell 50*a* through the gap 150*a*. Therefore, cooling of the center electrode 20 is accelerated, thereby restraining deterioration in the heat resistance performance of the ignition plug 100*a*. Notably, in the present embodiment, the width of the gap 150*a* defined by the first portion 401 of the metallic shell 50*a* is narrower than the width of the gap 150*a* defined by the second portion 402. Therefore, the longer the length E401 of the first portion 401, the greater the acceleration of heat conduction through the gap 150*a*.

In the case where the second smallest width dRn2 in the second range R2, which is located on the rearward direction Dfr side of the fourth range R4, is large, work of fixing the metallic shell 50*a* and the insulator 10*a* together can be facilitated. For example, contact between the outer circumferential surface 10*ao* of the insulator 10*a* and the inner circumferential surface 50*ai* of the metallic shell 50*a* is restrained. Therefore, accidental scratching of the insulator 10*a* is restrained. Also, in the event of vibration of the ignition plug 100*a*, unintentional contact between the insulator 10*a* and the metallic shell 50*a* is restrained. As a result, breakage of the insulator 10*a* is restrained.

In the present embodiment, the tubular portion 110 of the insulator 10*a* has a fixed outside diameter. The tubular portion 301*a* of the metallic shell 50*a* varies in inside diameter with a position along the axial line CL. Presumably, similar to the ignition plug 100 of the first embodiment, the ignition plug 100*a* having such a structure can improve the heat resistance performance and the durability of the insulator 10*a* by means of formation of the gap 150*a* between the insulator 10*a* and the metallic shell 50*a*.

For example, preferably, in the first range R1, the difference between the inside diameter of the metallic shell 50*a* and the outside diameter of the insulator 10*a* is 0.2 (mm) or less. That is, preferably, the first largest width dRx1 is 0.1 (0.2/2) (mm) or less. Preferably, in the second range R2, the difference between the inside diameter of the metallic shell 50*a* and the outside diameter of the insulator 10*a* is greater than 0.2 (mm). That is, preferably, the second smallest width dRn2 is greater than 0.1 (0.2/2) (mm). Preferably, the largest inside diameter of the metallic shell 50*a* in the first range R1 is smaller than the smallest inside diameter of the metallic shell 50*a* in the second range R2. That is, preferably, the first largest inside diameter Dx11 is smaller than the second smallest inside diameter Dn12. Presumably, when the ignition plug 100*a* has the above-mentioned structure, similar to various samples of FIG. 4B (e.g., sample Nos. B4 to B9 and B11 to B14), the heat resistance performance of the ignition plug 100*a* can be improved.

Also, preferably, in at least a portion of the first range R1, the difference between the inside diameter of the metallic shell 50*a* and the outside diameter of the insulator 10*a* is 0.1 (mm) or less. Presumably, when the ignition plug 100*a* has the above-mentioned structure, similar to sample Nos. B9 and B11 to B14 of FIG. 4B, the heat resistance performance of the ignition plug 100*a* can be improved. For example, preferably, the first largest width dRx1 in FIG. 5 is 0.05 (0.1/2) (mm) or less. Notably, the difference between the inside diameter of the metallic shell 50*a* and the outside diameter of the insulator 10*a* may be 0.1 (mm) or less only in a portion of the first range R1.

Also, preferably, in at least a portion of the first range R1, the difference between the inside diameter of the metallic shell 50*a* and the outside diameter of the insulator 10*a* is 0.05 (mm) or less. Presumably, when the ignition plug 100*a* has the above-mentioned structure, similar to sample Nos.

B11 to B14 of FIG. 4B, the heat resistance performance of the ignition plug 100*a* can be improved. For example, preferably, the first largest width dRx1 in FIG. 5 is 0.025 (0.05/2) (mm) or less. Notably, the difference between the inside diameter of the metallic shell 50*a* and the outside diameter of the insulator 10*a* may be 0.05 (mm) or less only in a portion of the first range R1.

Also, preferably, in the third range R3, the difference between the inside diameter of the metallic shell 50*a* and the outside diameter of the insulator 10*a* is 0.2 (mm) or less. Presumably, when the ignition plug 100*a* has the above-mentioned structure, similar to sample Nos. B5 to B9 and B12 to B14 of FIG. 4B, the heat resistance performance of the ignition plug 100*a* can be improved. For example, preferably, the third largest width dRx3 in FIG. 5 is 0.1 (0.2/2) (mm) or less. Notably, in at least a portion of the third range R3, the difference between the inside diameter of the metallic shell 50*a* and the outside diameter of the insulator 10*a* may be greater than 0.2 mm.

Preferably, over the entire first range R1, the difference between the inside diameter of the metallic shell 50*a* and the outside diameter of the insulator 10*a* is 0.1 (mm) or less. Presumably, when the ignition plug 100*a* has the above-mentioned structure, similar to sample Nos. B9 and B11 to B14 of FIG. 4B, the heat resistance performance of the ignition plug 100*a* can be improved. For example, preferably, the first largest width dRx1 in FIG. 5 is 0.05 (0.1/2) (mm) or less.

Preferably, over the entire first range R1, the difference between the inside diameter of the metallic shell 50*a* and the outside diameter of the insulator 10*a* is 0.05 (mm) or less. Presumably, when the ignition plug 100*a* has the above-mentioned structure, similar to sample No. B11 of FIG. 4B, the heat resistance performance of the ignition plug 100*a* can be improved. For example, preferably, the first largest width dRx1 in FIG. 5 is 0.025 (0.05/2) (mm) or less. Presumably, even when the length E401 of the first portion 401 of the metallic shell 50*a* is shorter than the distance L, similar to sample No. B11, the heat resistance performance is good. For example, the length E401 may be (1/3)L.

A preferred range of the length E401 of the first portion 401 of the metallic shell 50*a* may be determined in a manner of determination of the preferred range of the length E101 of the first portion 101 of the insulator 10 of the ignition plug 100 (FIG. 2A, etc.). For example, the length E401 of the first portion 401 may be equal to or less than (3/2)L. Also, the length E401 may be equal to or greater than (1/3)L.

D. Modified Embodiments (1) The insulator may have various structures other than those of the above embodiments. For example, a portion of the insulator between the outer step portion 16 and the large-diameter portion 14 may include a taper portion reducing gradually in outside diameter in the rearward direction Dfr (called a first taper portion). The first taper portion may be provided in the first range R1, in the second range R2, in the third range R3, or in a range between the third position 230 and the fourth position 240. In any case, the outer circumferential surface of the insulator may be formed by any method. For example, the outer circumferential surface of the insulator may be formed by forming a material by use of a forming die before firing.

(2) The metallic shell may have various structures other than those of the above embodiments. For example, a portion of the metallic shell between the support portion 56*r* and the outward protruding portion 54 may include a taper portion increasing gradually in inside diameter in the rearward direction Dfr (called a second taper portion). The second taper portion may be provided in the first range R1, in the second range R2, in the third range R3, or in a range between the third position 230 and the fourth position 240. In any case, the inner circumferential surface of the metallic shell may be formed by any method. For example, the inner circumferential surface of the metallic shell may be formed by cutting.

(3) The distance L from the boundary position 210 to the rear end position 230 may assume various values other than 1.8 (mm). For example, the distance L may fall in a range from 0.3 (mm) to 3.6 (mm). In the case where a strong force is applied to the insulator in the course of manufacture of the ignition plug, in order to restrain breakage of the insulator, the distance L is preferably long. For example, in formation of the members (e.g., the seals 72 and 74 and the resistor 73) disposed in the through holes 12 of the insulators 10 and 10*a* of the above embodiments, force is applied to the members in the through holes 12 as a result of insertion of the respective metal terminals 40. In order to restrain breakage of the insulators 10 and 10*a* as a result of application of force, the distance L is preferably long. For example, the distance L is preferably 1.5 (mm) or greater. In the case of application of a weak force to the insulator in the course of manufacture of the ignition plug, the distance L may be short. For example, the following structure may be employed: the center electrode and the metal terminal are directly connected in the through hole of the insulator, and a heat resistant bonding agent (e.g., cement, a ceramic bonding agent, or the like) may be charged into a gap in the through hole. In this case, since force applied to the insulator 10 is weak, the distance L may be short. For example, the distance L may assume various values equal to or greater than 0.3 (mm). In any case, the employment of a short distance L is preferred for reduction in size of the ignition plug. For example, the distance L is preferably 3.6 (mm) or less.

(4) The ignition plug may have various structures other than those of the above embodiments. For example, the ignition plug may be formed by use of the insulator 10 of the first embodiment (FIGS. 2A and 3) and the metallic shell 50*a* of the second embodiment (FIG. 5). The nominal size of the external thread portion 57 is not limited to M10 (10 mm), and the external thread portion 57 may employ various other sizes (e.g., M8 (8 mm), M12 (12 mm), and M14 (14 mm)). The forward-end-side packing 8 may be omitted. In this case, the support portion 56*r* of the metallic shell may directly support the outer step portion 16 of the insulator.

A discharge gap may be formed between the ground electrode and a side surface (a surface located away from the axial line CL in a direction perpendicular to the axial line CL) of the center electrode in place of the forward end surface (e.g., the surface of the first tip 29 on the forward direction Df side in FIG. 1) of the center electrode. The total number of discharge gaps may be two or more. Also, the ground electrode 30 may be eliminated. In this case, discharge may be generated between the center electrode of the ignition plug and another member located within a combustion chamber.

The present invention has been described with reference to the above embodiments and modified embodiments. However, the embodiments and modified embodiments are meant to help understand the invention, but are not meant to limit the invention. The present invention may be modified or improved without departing from the gist of the invention and encompasses equivalents of the invention.

DESCRIPTION OF REFERENCE NUMERALS AND SYMBOLS

8: forward-end-side packing; 10, 10*a:* insulator; 10*o*, 10*ao:* outer circumferential surface; 11: first inside-diameter-reducing portion (inner step portion); 12: through hole (axial hole); 13: rear-end-side trunk portion; 14: large-diameter portion; 15, 15*a:* forward-end-side trunk portion; 15L: straight line portion; 15*x:* first imaginary straight line; 16: connection portion (outer step portion); 16L: straight line portion; 16*x:* second imaginary straight line; 18: connection portion (rear-end-side outside-diameter-reducing portion); 19: leg portion; 20: center electrode; 21: outer layer; 22: core; 23: collar portion; 24: head portion; 25: diameter-reducing portion; 27: rod portion; 28: body portion; 29: first tip; 30: ground electrode; 31: outer layer; 32: inner layer; 33: proximal end portion; 34: distal end portion; 37: body portion; 39: second tip; 40: metal terminal; 41: portion; 50, 50*a:* metallic shell; 50*i*, 50*ai:* inner circumferential surface; 51: tool engagement portion; 52: forward-end-side trunk portion; 53: rear end portion; 54: outward protrusion; 54*f:* metallic-shell seating surface; 55: forward end surface; 56: inward protrusion; 56*r:* support portion; 57: external thread portion; 58: connection portion; 59: through hole; 61, 62: ring member; 70: talc; 72: first seal; 73: resistor; 74: second seal; 80: gasket; 100, 100*a:* ignition plug; 101: first portion; 101*e:* rear end; 102: second portion; 103: connection portion; 110: tubular portion; 150, 150*a:* gap; 154, 154*a:* connection portion; 210: first position (boundary position); 220: second position; 230: third position (rear end position); 240: fourth position; 250: fifth position; 300: contact portion; 301, 301*a:* tubular portion; 401: first portion; 401*e:* rear end; 402: second portion; 403: connection portion; g: discharge gap; R1: first range; R2: second range; R3: third range; R4: fourth range; CL: center axis (axial line); Df: forward-end direction (forward direction); and Dfr: rear-end direction (rearward direction).

What is claimed is:

1. An ignition plug comprising:

an insulator having a through hole extending from a rear-end side toward a forward-end side along an axial line;

a tubular metallic shell fixed to an outer circumference of the insulator and extending along the axial line; and a center electrode inserted at least partially into a portion of the through hole of the insulator, the portion being located on the forward-end side;

the insulator having a large-diameter portion having a largest outside diameter, a forward-end-side trunk portion connected to an end of the large-diameter portion on the forward-end side and smaller in outside diameter than the large-diameter portion, and an outer step portion connected to an end of the forward-end-side trunk portion on the forward-end side and reducing in outside diameter toward the forward-end side, the forward-end-side trunk portion having an inner step portion reducing in inside diameter toward the forward-end side, the metallic shell having a support portion reducing in inside diameter toward the forward-end side and supporting directly or indirectly the outer step portion of the insulator, and the center electrode having a diameter-reducing portion reducing in outside diameter toward the forward-end side and supported by the inner step portion of the insulator, wherein, with L representing a distance along the axial line from a boundary position, which is the position of a boundary between the forward-end-side trunk portion and the outer step portion of the insulator in a direction of the axial line, to a rear-end position of a contact region between the diameter-reducing portion of the center electrode and the inner step portion of the insulator, a difference between an inside diameter of the metallic shell and an outside diameter of the insulator is 0.2 mm or less in a first range ranging from the boundary position to a position which is located on the rear-end side of the boundary position and whose distance from the boundary position along the axial line is L/3;

the difference between the inside diameter of the metallic shell and the outside diameter of the insulator is greater than 0.2 mm in a second range located on the rear-end side of a position which is located on the rear-end side of the boundary position and whose distance from the boundary position along the axial line is 3L/2, the second range being located on the forward-end side of the large-diameter portion; and a relation of $0.9 \leq Dn2/Dx1 < 1$ is satisfied between a largest outside diameter Dx1 of the insulator in the first range and a smallest outside diameter Dn2 of the insulator in the second range.

2. An ignition plug comprising:

an insulator having a through hole extending from a rear-end side toward a forward-end side along an axial line;

a tubular metallic shell fixed to an outer circumference of the insulator and extending along the axial line; and a center electrode inserted at least partially into a portion of the through hole of the insulator, the portion being located on the forward-end side;

the insulator having a large-diameter portion having a largest outside diameter, a forward-end-side trunk portion connected to an end of the large-diameter portion on the forward-end side and smaller in outside diameter than the large-diameter portion, and an outer step portion connected to an end of the forward-end-side trunk portion on the forward-end side and reducing in outside diameter toward the forward-end side, the forward-end-side trunk portion having an inner step portion reducing in inside diameter toward the forward-end side, the metallic shell having a support portion reducing in inside diameter toward the forward-end side and supporting directly or indirectly the outer step portion of the insulator, and the center electrode having a diameter-reducing portion reducing in outside diameter toward the forward-end side and supported by the inner step portion of the insulator, wherein, with L representing a distance along the axial line from a boundary position, which is the position of a boundary between the forward-end-side trunk portion and the outer step portion of the insulator in a direction of the axial line, to a rear-end position of a contact region between the diameter-reducing portion of the center electrode and the inner step portion of the insulator, a difference between an inside diameter of the metallic shell and an outside diameter of the insulator is 0.2 mm or less in a first range ranging from the boundary position to a position which is located on the rear-end side of the boundary position and whose distance from the boundary position along the axial line is L/3;

the difference between the inside diameter of the metallic shell and the outside diameter of the insulator is greater than 0.2 mm in a second range located on the rear-end side of a position which is located on the rear-end side of the boundary position and whose distance from the boundary position along the axial line is 3L/2, the second range being located on the forward-end side of the large-diameter portion; and a largest inside diameter of the metallic shell in the first range is smaller than a smallest inside diameter of the metallic shell in the second range.

3. An ignition plug according to claim 1, wherein, in at least a portion of the first range, the difference between the inside diameter of the metallic shell and the outside diameter of the insulator is 0.1 mm or less.

4. An ignition plug according to claim 1, wherein, in at least a portion of the first range, the difference between the inside diameter of the metallic shell and the outside diameter of the insulator is 0.05 mm or less.

5. An ignition plug according to claim 1, wherein the difference between the inside diameter of the metallic shell and the outside diameter of the insulator is 0.2 mm or lesson in a third range located on the rear-end side of a position which is located on the rear end side of the boundary position and whose distance from the boundary position along the axial line is L/3, the third range being located on the forward-end side of a position which is located on the rear end side of the boundary position and whose distance from the boundary position along the axial line is L.

6. An ignition plug according to claim 1, wherein, over the entire first range, the difference between the inside diameter of the metallic shell and the outside diameter of the insulator is 0.1 mm or less.

7. An ignition plug according to claim 1, wherein, over the entire first range, the difference between the inside diameter of the metallic shell and the outside diameter of the insulator is 0.05 mm or less.

8. An ignition plug according to claim 2, wherein, in at least a portion of the first range, the difference between the inside diameter of the metallic shell and the outside diameter of the insulator is 0.1 mm or less.

9. An ignition plug according to claim 2, wherein, in at least a portion of the first range, the difference between the inside diameter of the metallic shell and the outside diameter of the insulator is 0.05 mm or less.

10. An ignition plug according to claim 2, wherein the difference between the inside diameter of the metallic shell and the outside diameter of the insulator is 0.2 mm or lesson in a third range located on the rear-end side of a position which is located on the rear end side of the boundary position and whose distance from the boundary position along the axial line is L/3, the third range being located on the forward-end side of a position which is located on the rear end side of the boundary position and whose distance from the boundary position along the axial line is L.

11. An ignition plug according to claim 2, wherein, over the entire first range, the difference between the inside diameter of the metallic shell and the outside diameter of the insulator is 0.1 mm or less.

12. An ignition plug according to claim 2, wherein, over the entire first range, the difference between the inside diameter of the metallic shell and the outside diameter of the insulator is 0.05 mm or less.

* * * * *